United States Patent [19]

Gogniat et al.

[11] Patent Number: 4,623,262

[45] Date of Patent: Nov. 18, 1986

[54] TIMEPIECE HAVING A TRANSPARENT ELEMENT PARTIALLY COVERED BY A COATING

[75] Inventors: Paul Gogniat; Eric Loth, both of Bienne, Switzerland

[73] Assignee: Montres Rado S.A., Lengnau B. Biel, Switzerland

[21] Appl. No.: 508,919

[22] Filed: Jun. 29, 1983

[30] Foreign Application Priority Data

Jul. 9, 1982 [CH] Switzerland ..... 4183/82

[51] Int. Cl.[4] ..... G04B 37/00

[52] U.S. Cl. ..... 368/294; 368/296; 368/306

[58] Field of Search ..... 368/294–296, 368/285, 286

[56] References Cited

U.S. PATENT DOCUMENTS

| | | | |
|---|---|---|---|
| 3,173,201 | 3/1965 | Motson | 228/124 |
| 3,551,997 | 10/1967 | Etter | 228/209 |
| 4,475,822 | 10/1984 | Muller et al. | 369/296 |

*Primary Examiner*—Bernard Roskoski

*Attorney, Agent, or Firm*—Peter L. Berger

[57] ABSTRACT

A timepiece containing, primarily, a first transparent element (1) visible from the outside of the piece, characterized in that this element has an adherent lining (2, 4) applied to at least part of its surface and assuring the attachment to that element of a decorative outer coating of hard material (3) and/or of a layer of high-temperature soldering material (5).

32 Claims, 18 Drawing Figures

TIMEPIECE HAVING A TRANSPARENT ELEMENT PARTIALLY COVERED BY A COATING

BACKGROUND OF THE INVENTION

This invention concerns a timepiece, and it relates in particular to new developments involving transparent elements visible from outside the piece, like the crystal, for example.

In putting together the components of the timepiece assembly, one of the most difficult problems to solve resides in establishing a connection between the transparent elements, usually of glass or sapphire, and other metal elements of the design. For example, to assemble the crystal on the back case of a watch case, numerous solutions have previously been proposed. That assembly can be carried out, for example, by means of mechanical locking parts, of the clamp, slide or screw type, or even by retention in a catch with or without insertion of a gasket. These designs are usually bulky and require particular arrangements in the crystal or case, which increase the difficulty of manufacture. Furthermore, that type of fastening of the crystal requires it to be thick enough.

It was also previously proposed that the crystal be attached by gluing on the case. That method of connection presents the disadvantages of a relatively low breaking stress, in the order of 5 kg/mm$^2$ at most, and poor endurance due to degradation of the glue by external conditions (transpiration, thermal shocks, ultraviolet rays, etc.).

Still another solution is described in Swiss Pat. No. 582,909 or Japanese Pat. No. 56-96267. It consists of using for assembly of the crystal to the square an intermediate layer of solder with low melting temperature and tin-lead, gold-indium or gold-tin alloy base. Tests conducted by the applicant show that the adherence of the layer of solder to the glass is in the order of 6 kg/mm$^2$. The choice of solder materials is limited and they tend to oxidize in the course of use. Furthermore, in order for the solder not to give an unattractive appearance to the lower part of the crystal, it is necessary to submit that zone to various metal coatings preventing diffusion of the solder to the crystal.

That is why one of the objects of this invention is to provide an externally visible transparent element of a timepiece which can be attached to another element by high-temperature soldering. Another object of the invention is to propose such a piece in which the transparent element is capable of receiving an outer decorative coating of hard material.

In that connection, it is to be noted that it is known how to make decorative or masking metal linings under crystals, those linings not being placed on an outer surface of the crystal, but being visible through it and protected by that same crystal. For the first time, the invention provides making coatings of hard material, which can, for example, but not exclusively, mask the high-temperature soldering bonds established according to the first aspect of the invention.

The advantages of such an arrangement are linked to the new esthetic effects that can thus be obtained. By placing hard decorative coatings directly on the outer surface of a crystal, it is possible, notably, to give it a very surprising appearance and a heretofore unexploited impression of depth. One can, for example, create the illusion that the crystal is surrounded by a metal rim of complex shape, etched, etc., by judiciously economizing on application of the outer lining or by successively making linings not fully overlapping, it is even possible to obtain the effects of ranges of colors on the edges of the lining. Another advantage of the use of hard outer linings is that they make it possible to mask possible surface defects on the crystal, which, on the other hand, are revealed in the case of linings applied under the crystal and visible through the latter.

These objects are accomplished according to the invention by providing on a transparent element of a timepiece an adherent lining assuring the attachment of a decorative coating and/or of an outer layer of high-temperature soldering material. Such a lining, which had heretofore not been proposed in the application described, is deposited preferably according to the chemical vapor deposit (CVD) process, which makes it possible to obtain excellent results.

In particular, the invention makes it possible to attain breaking stresses for the upper lining of 15 kg/mm$^2$, which is comparable to the tensile strength of the sapphire itself, which ranges between 19 and 50 kg/mm$^2$, depending on the direction of pull.

This results in new design possibilities, which also is an integral part of the invention and, notably, enables the crystal to be used as a central element of the assembly, to which the case, the band connecting parts and the decorative elements or decorative outer coatings will, for example, be attached.

BRIEF DESCRIPTION OF THE DRAWINGS

The invention will be clearly understood by reading the following specification, given with reference to the drawings, among

DETAILED DESCRIPTION OF THE DRAWINGS

Figure 1:
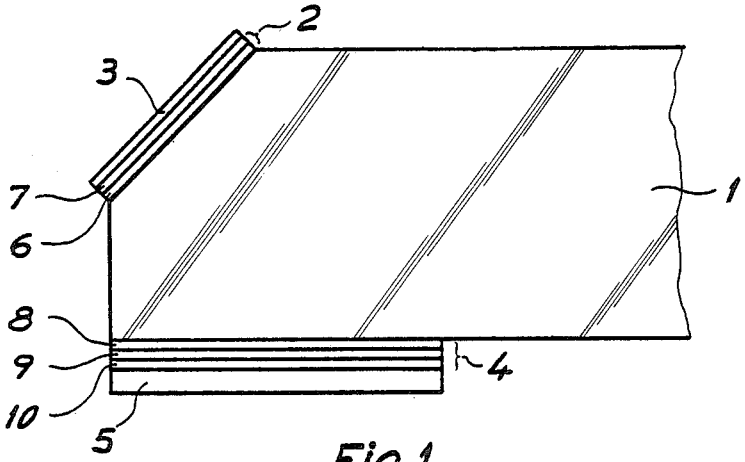
FIG. 1 is a schematic view in partial section of a watch crystal according to the invention.

FIG. 1 shows a partial section of a sapphire or glass crystal 1, forming a timepiece component according to the invention. That crystal 1 contains an adherent lining 2 assuring the attachment of a decorative outer coating 3 and an adherent lining 4 assuring the attachment of a layer of high-temperature soldering material 5.

The decorative coating 3 consists of a hard material, e.g., metal, of the titanium nitride or carbide type, which, in addition to great hardness enabling it to retain a bright appearance, by reason of its unscratchable character, presents tones very close to those of gold. Of course, other materials could be used and, in particular, carbides, borides or nitrides of metals of the tantalum, tungsten or chromium type or other compounds presenting a suitable appearance and hardness. As far as the adherent lining 2 is concerned, it can contain a single layer adhering to the crystal and assuring a good bond with the decorative coating 3 or several layers 6, 7 presenting good cohesion with each other, the bottom layer 6 adhering to the crystal 1 and the outer layer 7 adhering to the decorative coating 3. By way of nonlimitative example, layer 6 can be made up of aluminum oxide $Al_2O_3$, layer 7 being a chromium layer and decorative coating 3 being formed by titanium nitride. According to one particularly appropriate variant making possible the elimination of intermediate layer 7, the adherent lining can be made up of titanium oxide $TiO_2$, which is subsequently coated with titanium nitride TiN or titanium carbide TiC.

In the same way as for lining 2, adherent lining 4 can consist of one or more superposed layers (8, 9, 10) of different materials. For example, the layer 8 assuring attachment of the lining to the crystal 1 consists of aluminum oxide $Al_2O_3$, and the layer 10 assuring attachment of the layer of solder 5 is a tungsten carbide layer, while an intermediate layer 9 of tungsten assures the bond between both layers 8 and 10. The use of oxides for the crystal contact layer has proven particularly valuable.

The high-temperature soldering material forming layer 5 is understood to be an addition material capable of being applied in solid state between lining 4 and another element of the timepiece and then melted at a temperature in the order of 550° C. to 600° C. or more, depending on the nature of the elements to be joined, so as to form a permanent bond between those elements after cooling. Such materials are in widespread use and are employed, for example, for soldering steel parts. Their breaking stress is much higher than that of low-temperature soldering materials, usually exceeding 60 $kg/mm^2$. Their oxidation resistance, under normal conditions of use of a timepiece, is also much higher.

The process currently most suitable for the deposition of adherent linings 2 and 4 and making it possible to obtain breaking stresses of 10 $kg/mm^2$ to 15 $kg/mm^2$ and even more has proved to be the chemical vapor deposition process, also known as CVD deposition. That process consists of bringing materials in vapor phase to the surface of the crystal, maintained at a high temperature. That surface is then the site of a chemical reaction leading to a deposition of material. By using, for example, masks making it possible to subject only a part of the surface of the element to be lined to the action of gases, it is then possible to give any useful form to the lining obtained and to cover only those places that it is desired to protect with a decorative coating or to bond by soldering to another element of the timepiece.

It is, of course, possible to deposit by CVD only a part of the adherent lining and, in particular, its layer in contact with the crystal, other layers then being depositable on the first by other methods, as for example, by electroplating, if copper or nickel layers are involved.

It is to be understood that on FIG. 1 the thicknesses of the different layers indicated have been markedly exaggerated since thicknesses of a few micons actually are sufficient for the layers constituting the adherent linings.

Figure 2:
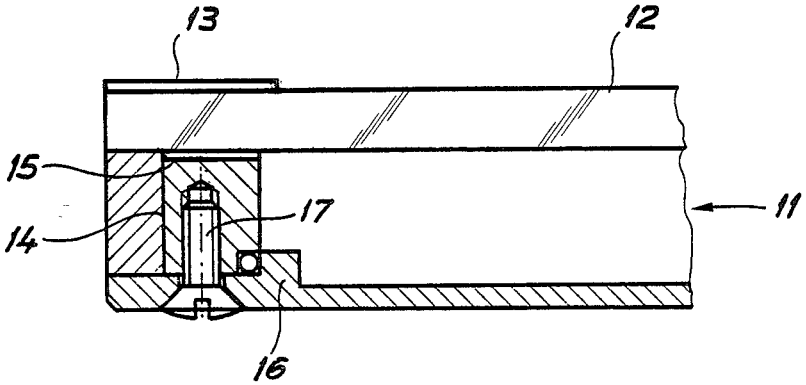
FIGS. 2 to 18 are schematic representations of timepiece elements according to different embodiments of the invention.

Represented in partial section in FIG. 2 is a watch case 11 containing a crystal 12, to which have been attached a decorative outer coating 13 and an annular member 14 soldered to the crystal 12 by means of a layer of solder 15. The crystal has been prepared in accordance with the foregoing explanations to make possible the attachment of layers 13 and 15. A back 16 is detachably mounted under the square 14 by means of a screw 17. The member 14 can be soldered on the crystal 12 after the adherent linings are formed on that crystal by spreading the soldering material 15, which forms, for example, a frame of adequate dimensions between the two parts to be assembled and then placing the assembly thus formed in an induction furnace.

Figure 3:
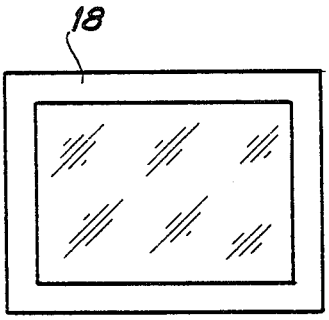
Figure 4:
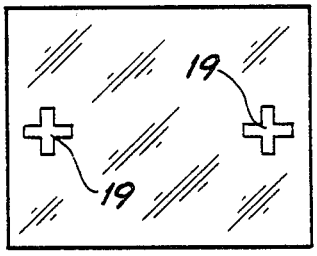

FIGS. 3 and 4 are top views of a lined crystal formed according to the invention and illustrate cases where a decorative coating forms either an annular frame or false rim 18 on the periphery of the crystal, which can be beveled, as on FIG. 1, or design motifs 19 intended for example to mask the fastening parts of the crystal of FIG. 8 described below.

Figure 5:
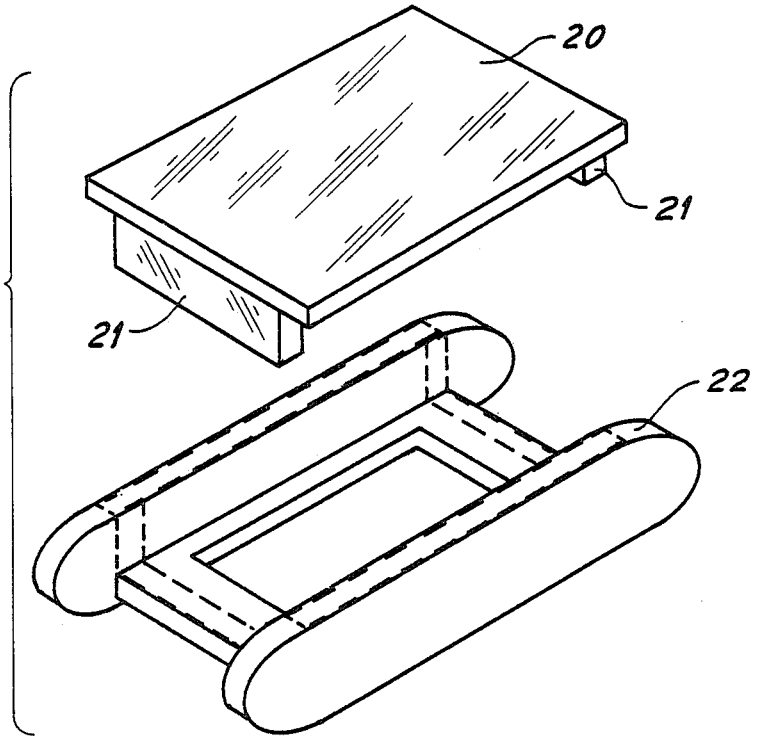

FIG. 5 represents an exploded view of another embodiment of a watch case according to the invention, in which a sapphire crystal 20 forming a top surface is provided with side walls 21 fixed on that crystal by high-temperature soldering and depending downwardly therefrom. The walls 21 are also made of sapphire, and the assembly thus formed is in turn attached to a metal element 22, also by high-temperature soldering, to form a watch case.

Figure 6:
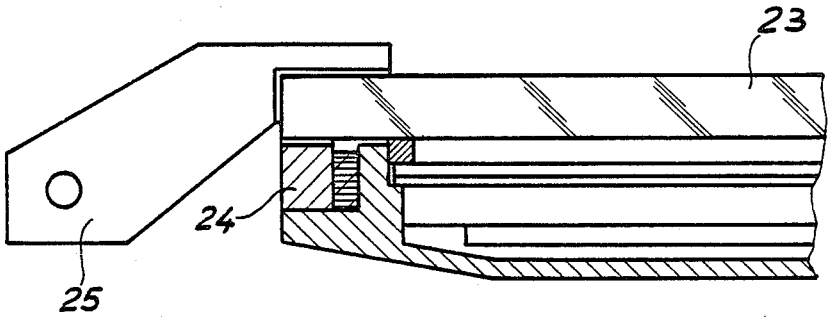

FIG. 6 represents in partial section another watch case according to the invention, in which a crystal 23 serves as support for a square member 24 and for the band fastening parts 25. The member 24 and the fastening parts 25 mounted on two opposite sides of the crystal 23 are attached to the latter by high-temperature soldering.

Figure 7:
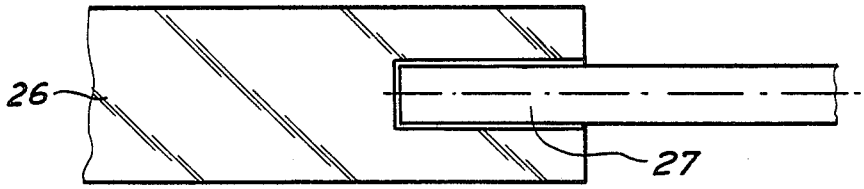
Figure 8:
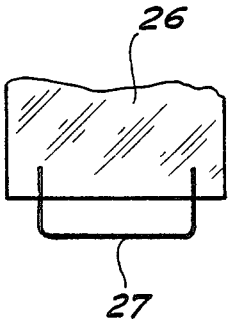

A variation of the foregoing design is represented in FIGS. 7 and 8, which show in cross-section and in top view respectively the side edge of a crystal 26 with holes in which wires 27 forming couplings of the band are soldered.

Figure 9:
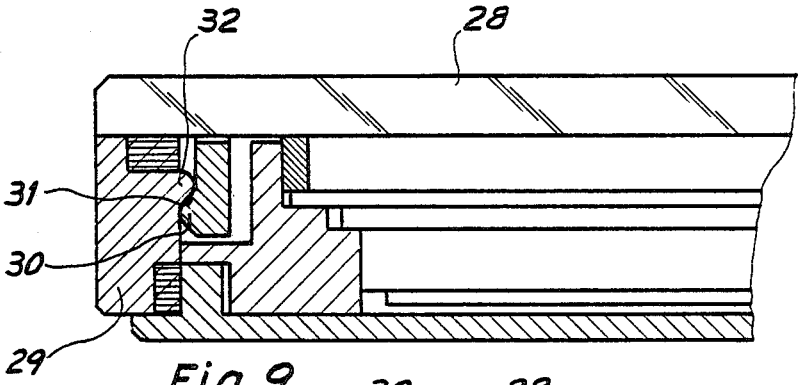
Figure 10:
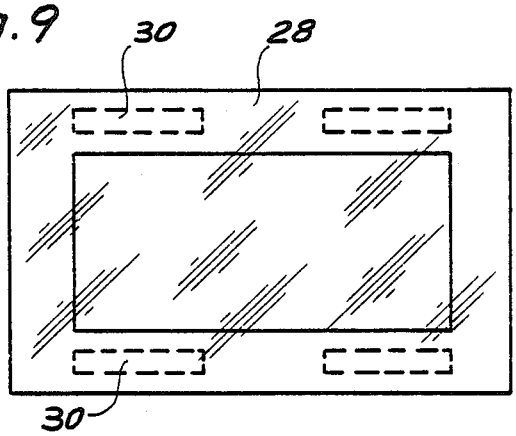

FIGS. 9 and 10 are partial sections and top views respectively of a watch case in which the crystal 28 is detachably fastened to a square member 29 by means of fastening parts 30. Fastening parts 30 are soldered at high temperature under the crystal and contain coupling surfaces 31 elastically working together with protuberances 32 of the inner surface of the member 29 for holding the assembly. There may be four such sets of fastening parts as shown in FIG. 10.

Figure 11:
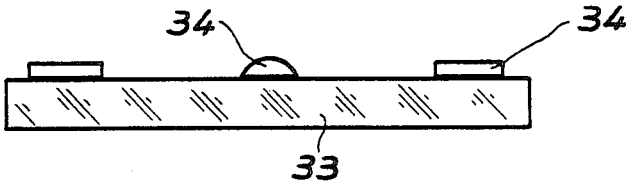
Figure 12:
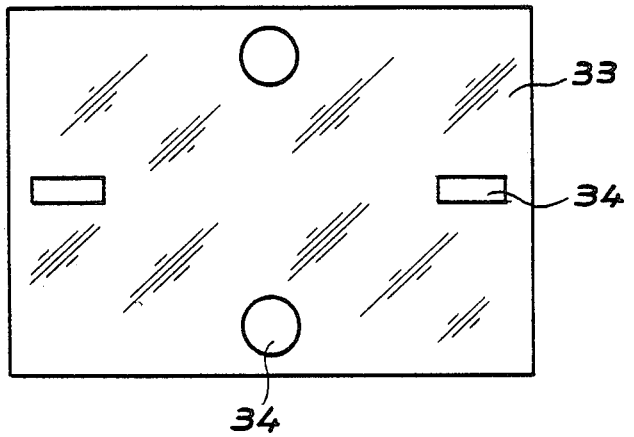

FIGS. 11 and 12 respectively represent in elevation and in top view a crystal 33 on which decorative design elements 34 are soldered. The latter are preferably made of hard metal.

Figure 13:
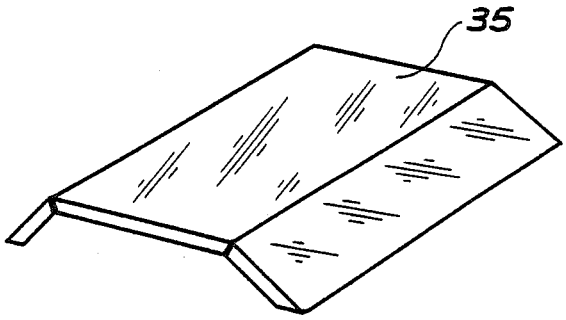
Figure 14:
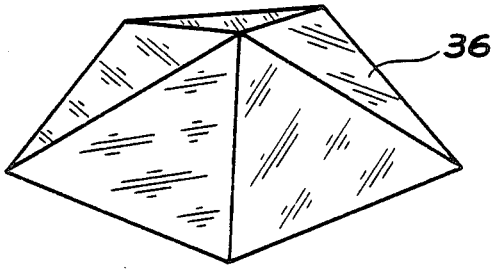

FIGS. 13 and 14 are perspective views of crystals 35 and 36 respectively made in several assembled elements by high-temperature soldering. In this case, it is clear that the surfaces opposite the elements assembled in pairs will receive the same adherent lining.

Figure 15:
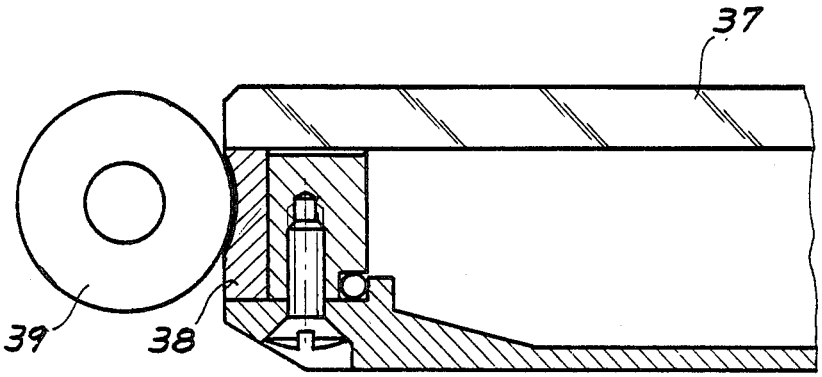

FIG. 15 represents in partial section a watch case in which the crystal 37 is assembled to a square member 38 by high-temperature soldering similar to FIG. 2, for example, but in which, furthermore, the band fastening parts 39, made of sapphire, are soldered by the same process to member 38.

Figure 16:
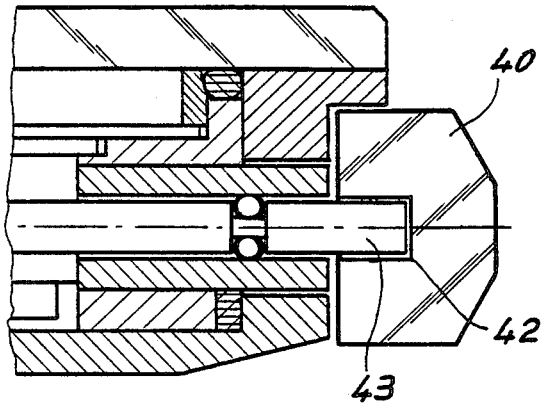
Figure 17:
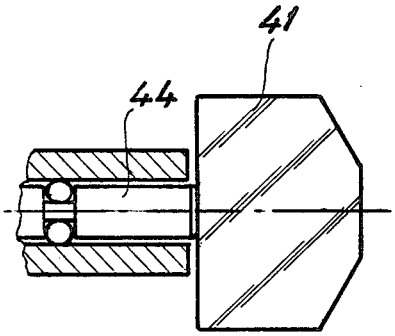

FIGS. 16 and 17 illustrate still other designs where the invention is used to assure the fastening of crowns 40 and 41 respectively on a hand-setting stem 43. For that purpose, the crown 40 is provided with a hole 42, the walls of which are precoated with an adherent lining and in which the stem 43 is soldered. As a variation, the end of the hand-setting stem 44 of FIG. 17 is directly soldered and butt-welded to the center of the crown 41, also precoated, as indicated above.

Figure 18:
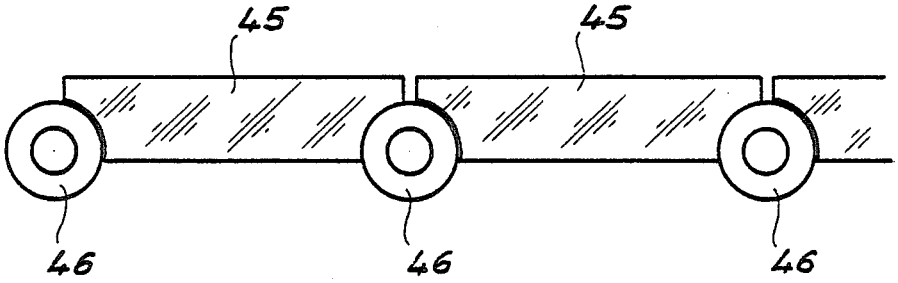

Finally, FIG. 18 illustrates another embodiment of the invention, in which an adherent lining is provided on the surface of the links 45 of a sapphire watch band, in order to make possible the soldering of the hinge parts 46 of that band, formed, for example, by metal tubes provided for the passage of hinge pins.

Although described in relation to some of its particular embodiments, this invention is not at all limited thereto but rather lends itself to numerous modifications and variations which will be evident to those skilled in the art.

What is claimed is;

1. A timepiece comprising:

a first transparent element visible from the outside of the timepiece, said first transparent element including an inner and an outer surface;

an inner adherent lining applied to at least part of said inner surface;

a layer of high temperature soldering material atached to said inner adherent lining for securing said crystal to a second element;

an outer adherent lining applied to at least part of said outer surface; and a decorative outer coating formed of a hard scratch-resistant material attached to and covering said outer adherent lining for masking said inner adherent lining and said layer of soldering material.

2. A timepiece according to claim 1, where the outer adherent lining is formed by a single layer of material adhering simultaneously to the outer surface of the transparent element and to the decorative coating.

3. A timepiece according to claim 1, wherein the outer adherent lining is formed by at least two superposed layers of different materials bonded to each other, one layer adhering to the outer surface of the transparent element and the other layer adhering to the decorative coating.

4. A timepiece according to claim 3, wherein the outer adherent lining further contains at least one intermediate layer assuring the bond between said two superposed layers.

5. A timepiece according to claim 1, wherein the outer adherent lining in contact with the transparent element comprises a layer of oxide.

6. A timepiece according to claim 5, wherein the oxide layer is a layer of $TiO_2$.

7. A timepiece according to claim 2, wherein the outer adherent lining in contact with the transparent element comprises a layer of oxide.

8. A timepiece according to claim 3, wherein the outer adherent lining in contact with the transparent element comprises a layer of oxide.

9. A timepiece according to claim 4, wherein the outer adherent lining in contact with the transparent element comprises a layer of oxide.

10. A timepiece according to claim 1, wherein said decorative coating includes a layer of titanium carbide or nitride.

11. A timepiece according to claim 1, wherein the inner adherent lining for the attachment of said layer of soldering material contains, primarily, a layer of tungsten covered by a layer of tungsten carbide.

12. A timepiece according to claim 1, wherein the inner adherent lining for the attachment of said layer of soldering material contains, primarily, a layer of tungsten covered by a layer of tungsten carbide.

13. A timepiece according to claim 1, wherein the inner adherent lining for the attachment of said layer of soldering material contains, primarily, a layer of tungsten covered by a layer of tungsten carbide.

14. A timepiece according to claim 1, wherein the breaking stress of the adherent linings is at least as great as 10 $kg/mm^2$.

15. A timepiece according to claim 14, wherein the adherent linings have a breaking stress of at least 15 $kg/mm^2$.

16. A timepiece according to claim 1, wherein the first transparent element is a crystal.

17. A timepiece according to claim 16, further comprising a second element attached to the first transparent element by means of the said layer of soldering material.

18. A timepiece according to claim 17, wherein said second element is a square member of a watch case.

19. A timepiece according to claim 17, wherein said second element is a band fastening part.

20. A timepiece according to claim 17, wherein said second element is a crystal fastening part.

21. A timepiece according to claim 17, wherein said second element is a component of a crystal comprising a plurality of pieces.

22. A timepiece according to claim 17, wherein said second element is a decorative element.

23. A timepiece according to claim 22, wherein the decorative element is made of hard metal.

24. A timepiece according to claim 1, wherein the first transparent element is a band fastening part attached to a second watch case element by means of the said layer of soldering material.

25. A timepiece according to claim 1, wherein the first transparent element is a crown attached to a hand-setting stem by means of the said layer of soldering material.

26. A timepiece according to claim 1, wherein the first transparent element is a band link attached to a hingepart by means of the said layer of soldering material.

27. A timepiece according to claim 1, wherein the first transparent element is made of sapphire.

28. A timepiece according to claim 1, wherein said inner adherent lining is formed of a single layer of material adhering simultaneously to the inner surface of the transparent element and to said layer of high temperature soldering material.

29. A timepiece according to claim 1, wherein said inner adherent lining is formed by at least two superposed layers of different materials bonded to each other, one layer adhering to the inner surface of the transparent element and the other layer adhering to said layer of high temperature soldering material.

30. A timepiece according to claim 29, wherein the inner adherent lining further contains at least one intermediate layer assuring the bond between said two superposed layers.

31. A timepiece according to claim 1, wherein the inner adherent lining in contact with the transparent element comprises a layer of oxide.

32. A timepiece according to claim 31, wherein the oxide layer is a layer of $TiO_2$.

* * * * *